US007584515B2

(12) United States Patent
Jones et al.

(10) Patent No.: US 7,584,515 B2
(45) Date of Patent: Sep. 8, 2009

(54) SNUGGLE POCKETS

(76) Inventors: Dianna Jones, 8501 W. 144 Pl., Overland Park, KS (US) 66223; Angelia Roy, 8501 W. 144 Pl., Overland Park, KS (US) 66223

( * ) Notice: Subject to any disclaimer, the term of this patent is extended or adjusted under 35 U.S.C. 154(b) by 0 days.

(21) Appl. No.: 11/897,294

(22) Filed: Aug. 30, 2007

(65) Prior Publication Data

US 2009/0056017 A1 Mar. 5, 2009

(51) Int. Cl.
*A47G 9/02* (2006.01)
*A47G 9/04* (2006.01)

(52) U.S. Cl. ..... 5/485; 5/494; 5/496; 5/497; 5/499; 2/69.5

(58) Field of Classification Search ..... 5/485, 5/494–500, 502, 482; 2/69.5, 69
See application file for complete search history.

(56) References Cited

U.S. PATENT DOCUMENTS 1,602,941 A * 10/1926 Rosman ..... 5/485
1,964,271 A * 6/1934 O'Dwyer ..... 128/873
2,062,611 A * 12/1936 Rosenthal ..... 5/494
2,462,780 A * 2/1949 Schiller ..... 5/485
2,481,741 A * 9/1949 Graves ..... 128/873
3,148,388 A * 9/1964 Espersen ..... 5/485
3,638,251 A * 2/1972 Weiss ..... 5/485
3,845,513 A * 11/1974 Hubner ..... 2/69.5
4,202,052 A * 5/1980 Bilanzich ..... 2/69.5
4,607,402 A * 8/1986 Pollard ..... 5/425
4,754,509 A * 7/1988 Pollard ..... 5/425
4,773,702 A * 9/1988 Takahashi et al. ..... 297/218.1
4,815,156 A 3/1989 Williams
4,873,734 A * 10/1989 Pollard ..... 5/425
4,924,543 A * 5/1990 Hoss et al. ..... 5/484
5,438,719 A * 8/1995 Anthony ..... 5/485
5,991,946 A * 11/1999 Harris ..... 5/497
6,182,312 B1 * 2/2001 Walpin ..... 5/636
6,381,778 B1 * 5/2002 Peterson ..... 5/497
6,408,467 B2 * 6/2002 Walpin ..... 5/636
6,415,466 B1 * 7/2002 Laiso ..... 5/485
6,539,565 B1 4/2003 Trimble
6,631,528 B2 * 10/2003 Landry ..... 5/494
6,651,278 B2 11/2003 Ghanem
6,681,422 B2 * 1/2004 Landry ..... 5/494
6,817,048 B1 * 11/2004 LaRosa ..... 5/494
6,848,131 B1 * 2/2005 Landry ..... 5/494
6,857,146 B2 * 2/2005 Landry ..... 5/494
6,928,678 B1 8/2005 Chang
7,111,344 B2 * 9/2006 French ..... 5/494
7,370,377 B2 * 5/2008 Landry ..... 5/494

(Continued)

OTHER PUBLICATIONS

Gershman, Maurice, M.D. "Self-Adhering Nylon Tapes." Journal of A.M.A. (vol. 168, No. 7) Oct. 18, 1958.*

*Primary Examiner*—Robert G Santos

(57) ABSTRACT

A fitted sheet-blanket (30) suitable for use with a crib or bassinet mattress (33) is provided. The fitted sheet-blanket can include a pocket coverlet (21) securely detachable on a top of the fitted sheet-blanket to form an open-ended pocket, and a pillow (13) securely detachable on the top of the fitted sheet-blanket and located above the open-ended pocket. The pocket coverlet can include one or more detachable inserts to provide an adjustable depth of the pocket relative to the pillow.

18 Claims, 7 Drawing Sheets

U.S. PATENT DOCUMENTS

2001/0018777 A1* 9/2001 Walpin ..... 5/636
2002/0108176 A1* 8/2002 Ragen ..... 5/482
2003/0154548 A1* 8/2003 Landry ..... 5/494
2003/0154549 A1* 8/2003 Landry ..... 5/494
2004/0019970 A1* 2/2004 Landry ..... 5/494
2004/0199999 A1* 10/2004 Landry ..... 5/494
2005/0028278 A1* 2/2005 Landry ..... 5/494
2007/0061968 A1* 3/2007 Fader ..... 5/494
2007/0157392 A1* 7/2007 Ragen ..... 5/655

* cited by examiner

SNUGGLE POCKETS

FIELD OF THE DISCLOSURE

The present disclosure relates generally to baby bedding and more specifically to safe and secure baby bedding.

BACKGROUND

Crib bedding has yet to be sufficiently modified to safely meet a baby's security, protection, and comfort ability needs. The American SIDS Institute states that about 2,500 babies die of Sudden Infant Death Syndrome (SIDS) in the U.S. every year. Approximately 95% of those babies are between two months old to one year old.

Typical baby bedding consists of a heavy comforter, a thin fitted sheet, a bed skirt and a crib bumper. The comforter and crib bumper are treacherous to babies, potentially causing suffocation or serious injuries. The crib sheet provides little protection or support to babies head or body. The American SIDS Institute and pediatricians tell parents to remove all crib bumpers and heavy blankets from their cribs, bassinets and pack-n-plays stating they are hazardous to babies.

DETAILED DESCRIPTION

Figure 1:
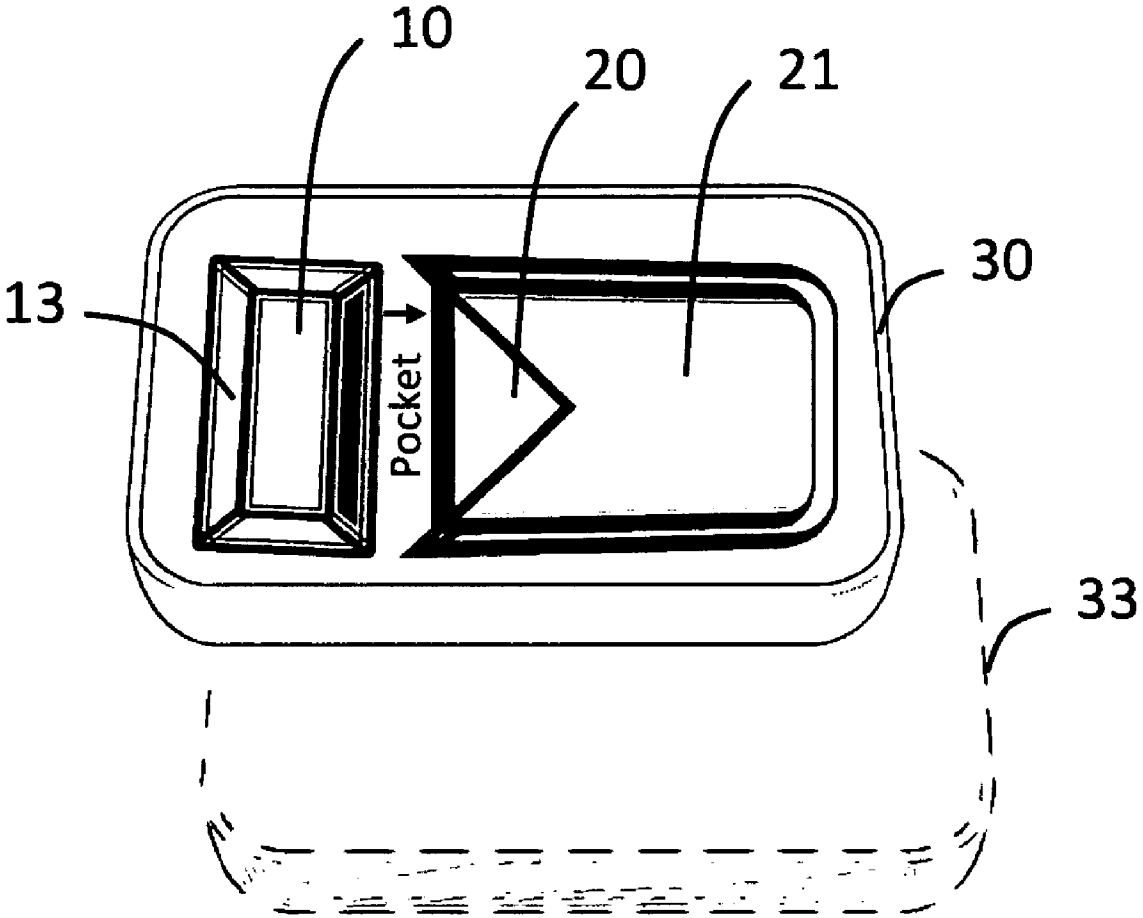
FIG. 1 shows a perspective view of a fitted sheet-blanket in accordance with one embodiment of the invention.

In one embodiment of the present disclosure, a fitted sheet-blanket suitable for use in a crib or bassinet is provided. The fitted sheet-blanket can include a pocket coverlet securely detachable on a top of the fitted sheet-blanket to form an open-ended pocket on the fitted sheet-blanket, and a pillow securely detachable on the top of the fitted sheet-blanket and located above the pocket. The pocket coverlet can include one or more detachable inserts to provide an adjustable depth of the pocket relative to the pillow.

In a second embodiment, a snuggle pocket suitable for use with a crib or bassinet is provided. The snuggle pocket can include a fitted sheet-blanket having a first attachment and second attachment on a top of the fitted sheet-blanket, a pocket coverlet securely detachable to the first attachment to form an open-ended pocket that is approximately centered on the fitted sheet-blanket, and a pillow securely detachable to the second attachment and located above the pocket that is also approximately centered on the fitted sheet-blanket. The fitted sheet-blanket is intended to fit taught around a crib or bassinet mattress. The pocket coverlet and pillow are approximately centered and held taut by the first attachment and second attachment on the fitted sheet-blanket.

In a third embodiment, a fitted sheet-blanket bedding suitable for use with a crib mattress or bassinet mattress is provided. The fitted sheet-blanket can include a pocket coverlet securely detachable by a first U-shaped zipper on a top of the fitted sheet-blanket to form an open-ended pocket approximately centered on the fitted sheet-blanket, and a pillow approximately centered, securely detachable and held down by a second U-shaped zipper on the top of the fitted sheet-blanket. The pillow can be located at least 2 inches above the pocket to provide head and neck support and to alleviate flattened head syndrome. The pocket coverlet can include one or more detachable safety bumpers positioned at a bottom of the open-ended pocket to provide an adjustable depth of the pocket. The fitted sheet-blanket can fit taut around the crib mattress or bassinet mattress, and the pocket coverlet can fit sufficiently taught on the first U-shaped zipper.

The term "taut" can be defined as pulled moderately tight or pulled tight. The term "fit taut" can be defined as pulled sufficiently tight to keep a baby securely and firmly positioned within a pocket. The term "attachment" can be defined as a holding or clasping device. The term "detachable" can be defined as an attachment that completely or partially holds two fabrics or bedding pieces together. The term "insert" can be defined as an insertable relocatable object. The term "bumper" can be defined as an object that provides boundaries to adjust a depth of a pocket. The term "slot" can be defined as a window opening or a layered opening. The term "sleeve" can be defined as a open or closed covering. The term "open-ended" can be defined as having one opening. The term "fitted" can be defined as having a matching size. The term "pocket coverlet" can be defined as a covered attachment that creates a pocket when held down taut. The term "sheet-blanket" can be defined as a sheet that fits on top of a mattress and provides warmth from underneath.

The present application discloses a zippered pocket coverlet and pillow attached to a fitted sheet-blanket that can be secured onto a crib and bassinet mattresses, called Snuggle Pocket(s). A baby can be secured into the snuggle pocket, which provides shelter and keeps the baby safely sleeping on it's back. The snuggle pocket can position the baby in the center of the crib away from crib railings that pose potential dangers. The pillow can provide comfort and protect the baby's neck and help to eliminate a flattened head (Positional Plagiocephaly). This safe crib bedding provided by Snuggle Pockets protects the baby from possible risks of Sudden Infant Death Syndrome (SID) and other sleeping dangers.

FIG. 1 depicts a top view of a snuggle pocket bedding showing an arrangement of bedding articles. The snuggle pocket bedding can include a fitted sheet-blanket 30 having a pocket coverlet 21 securely detachable on a top of the fitted sheet-blanket 30, and a pillow 13 securely detachable on the top of the fitted sheet-blanket 30 and located above the open-ended pocket. The pocket coverlet together with the fitted sheet-blanket 30 form an open-ended pocket on the fitted sheet-blanket 30.

The pocket coverlet 21 can also include a triangular extension 20, of the same or different material, that folds back to provide warmth to a baby's chest area. The fitted sheet-blanket 30 can fit taut around a crib or bassinet mattress 33 so as to secure a baby safely on it's back. The pocket coverlet 21 can be approximately centered on the fitted sheet-blanket so as to be sufficiently away from crib or bassinet railings. A triangular extension 20 can be a flap overlay that securely attaches to the pocket blanket to provide additional warmth to the baby's chest area. The pillow 13 can include a foam 10 to provide head comfort. As one example, the foam 10 can be a memory foam that helps a baby find a previously comfortable sleeping position.

Figure 2:
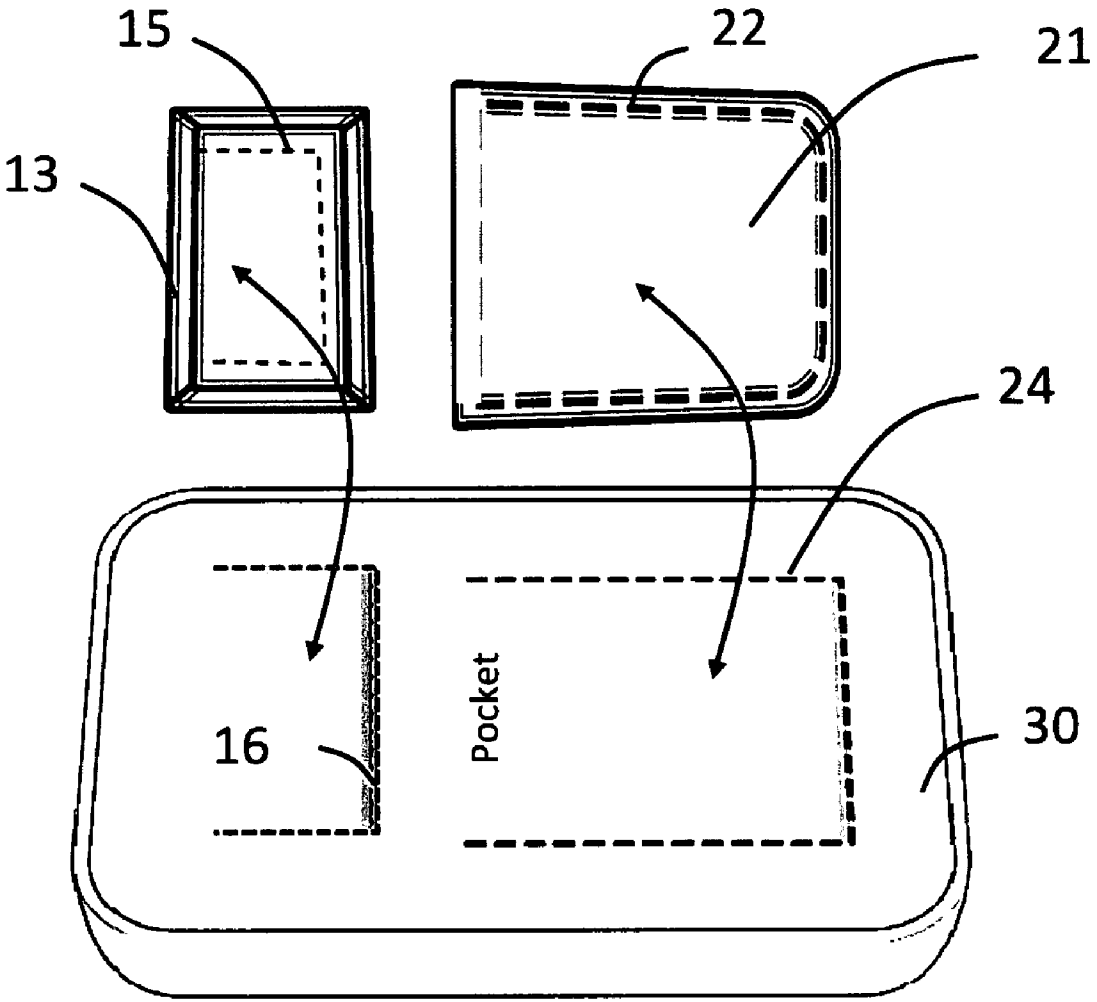
FIG. 2 shows portions of the fitted sheet-blanket of FIG. 1 in accordance with one embodiment of the invention.

FIG. 2 shows a top view of the sheet-blanket 30 as fitted on the mattress 33 illustrating how the pillow 13 and pocket coverlet 21 can be attached. In one embodiment, the pocket coverlet 21 can be fastened down by the first attachment 22/24 onto the fitted sheet-blanket 30 to form the pocket. As an example, the pocket coverlet can be fastened down by a first U-shaped zipper attachment open-ended at a top of the fitted sheet-blanket 30 to form the pocket. In such regard, the first attachment 22/24 can position the pocket coverlet 21 below the baby's arms away from the baby's breathing, or airflow. In one arrangement, the pocket coverlet 21 can be pulled sufficiently tight and fastened down 2 inches or more away from the pillow 13 such that the pocket coverlet 21 does not contact any portion of the pillow 13. The first attachment can be interchangeable with the pocket coverlet 21 such that the pocket coverlet 21 exposes a first fabric side to the interior of the open-ended pocket in a first arrangement, and a second fabric side to the interior of the open-ended pocket in a second arrangement.

The pillow 13 can be fastened down by the second attachment 15/16 onto the fitted sheet-blanket 30 above the pocket so as to prevent a baby's head from getting under the pillow 13. The pillow 13 can be positioned so that the babies head can rest in the center. As an example, the pillow 13 can be fastened down by a second U-shaped zipper attachment also open-ended at the top of the fitted sheet-blanket 30. This allows the pillow 13 to be fastened onto the fitted sheet-blanket 30 above the pocket, for example by at least 2 inches, so as to prevent a baby's head from getting under the pillow.

For example, sewn onto the fitted sheet-blanket 30 is a first zipper casing 24 for the bottom portion of the zipper. The other half of the zipper casing 22 can be sewn on the pocket coverlet 21. Sewn onto the fitted sheet-blanket 30 is a second zipper casing 16 for attachment to the bottom portion of the zipper. Sewn onto the pillow 13 is the other half of the zipper casing 15 for attachment to the bottom casing 16. Both the pillow 13 and pocket coverlet 21 can be attached or detached for purposes of safety and convenience.

Figure 4:
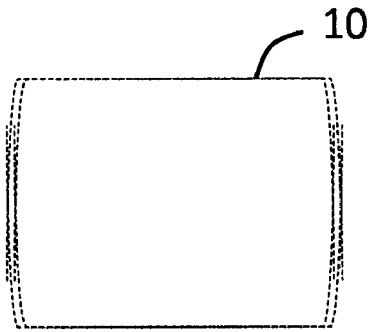
FIG. 4 shows a foam insert for a pillow in accordance with one embodiment of the invention.
Figure 3:
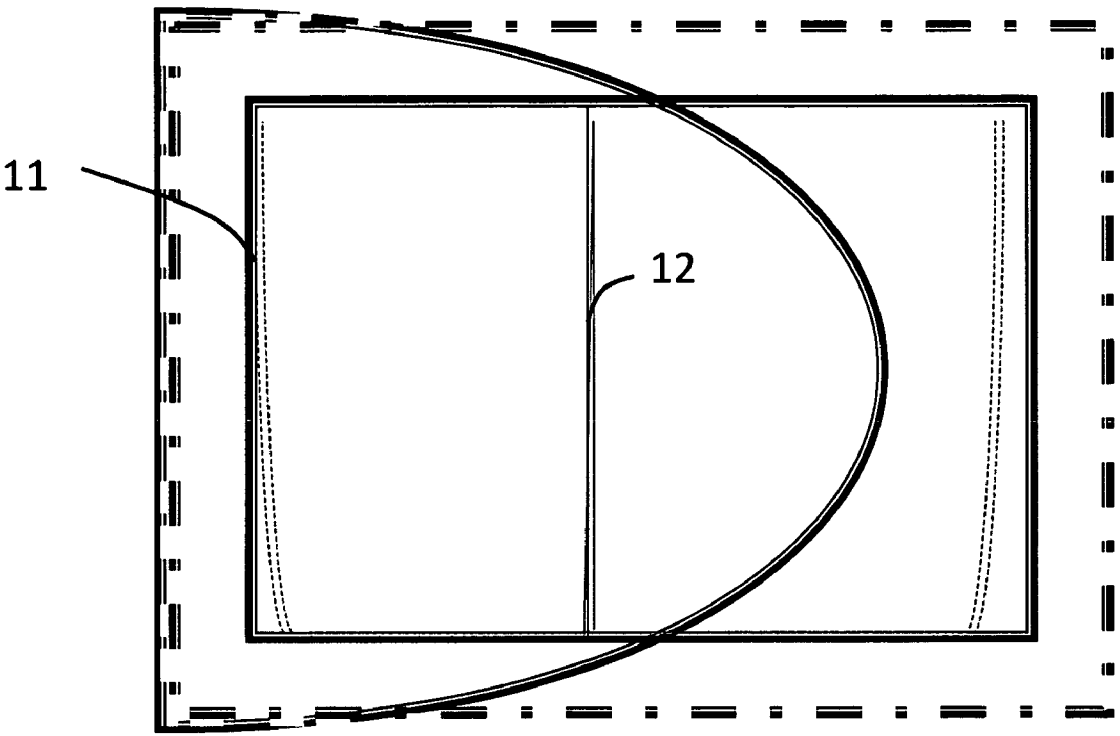
FIG. 3 shows a pillow attachment in accordance with one embodiment of the invention.

FIG. 3 depict a back view of the pillow 13. The foam 10 (See FIG. 4) can be inserted into slot 12 (or layered opening) in the pillow 10 to allow insertion and removal for cleaning and washing. The foam 10 can be enclosed in its own protective cover. In one arrangement, the pillow 13 may be less than two inches in thickness to ensure head and neck safety.

The memory foam 10 can help the baby lie in a recommended supine position which can reduce the effect of Positional Plagiocephaly, or flat head syndrome. The memory foam 10 also adds comfort created by a beneficial head and neck rest for the baby. The pillow can be less than 2 inches thick with the memory foam to distribute a weight of the baby's neck and head to alleviate flattened head syndrome.

Figure 6:
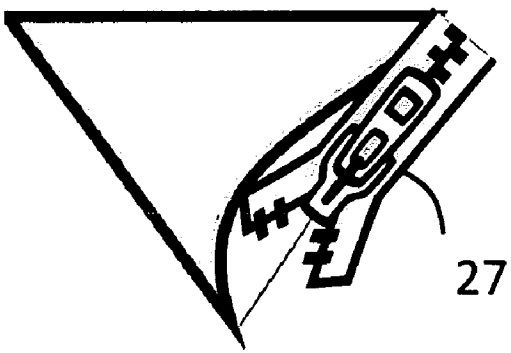
FIG. 6 shows an bedding article attachment in accordance with one embodiment of the invention.
Figure 5:
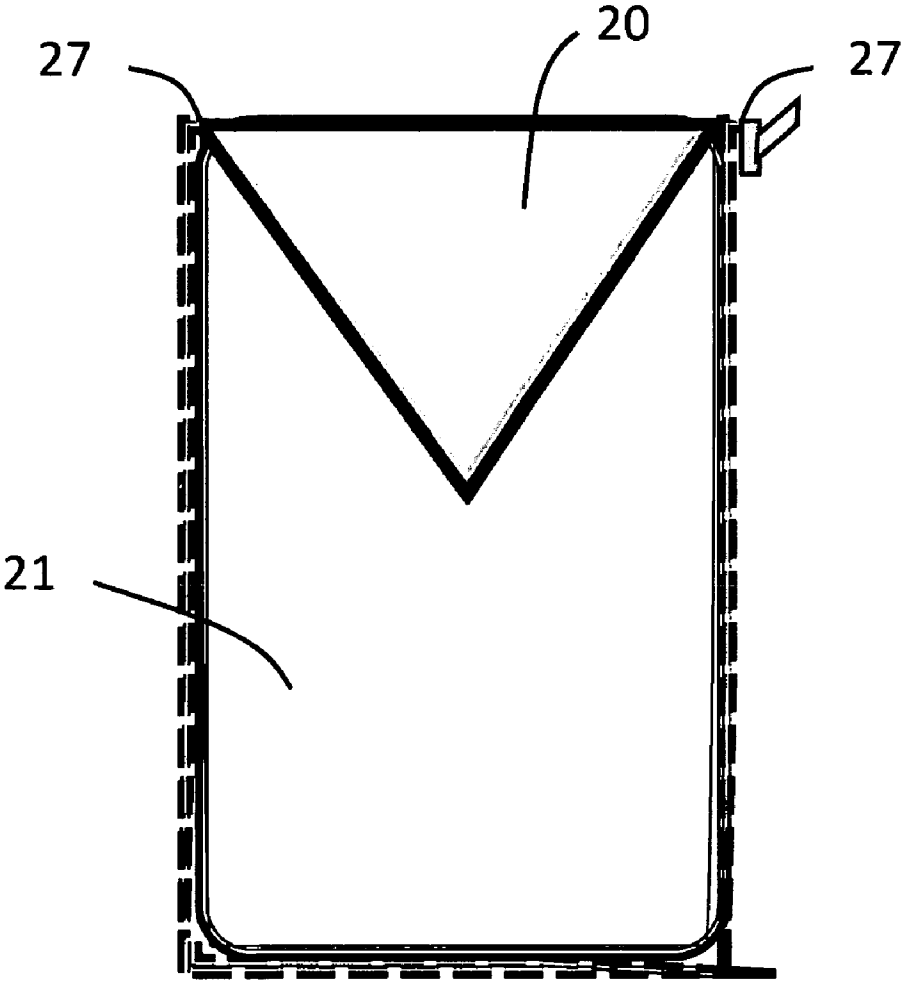
FIG. 5 shows a pocket coverlet in accordance with one embodiment of the invention.

FIG. 5 shows a top view of the pocket coverlet 21 which can include a zipper 27 along the border. The pocket coverlet 21 includes a triangular extension 20 (shown enlarged in FIG. 6) that can be a fabric extension of the pocket coverlet 21 to add warmth to the baby's chest area. The triangular extension 20 may be permanently secured to the pocket coverlet 20, or loosely secured as an extension of the material by a fastening device, such as a Velcro connector. The pocket coverlet can comprise cotton based material, or natural material but is not limited to these. The pocket coverlet 21 may have upwards of 2 layers for added warmth, which can be selectively added or removed.

Figure 7:
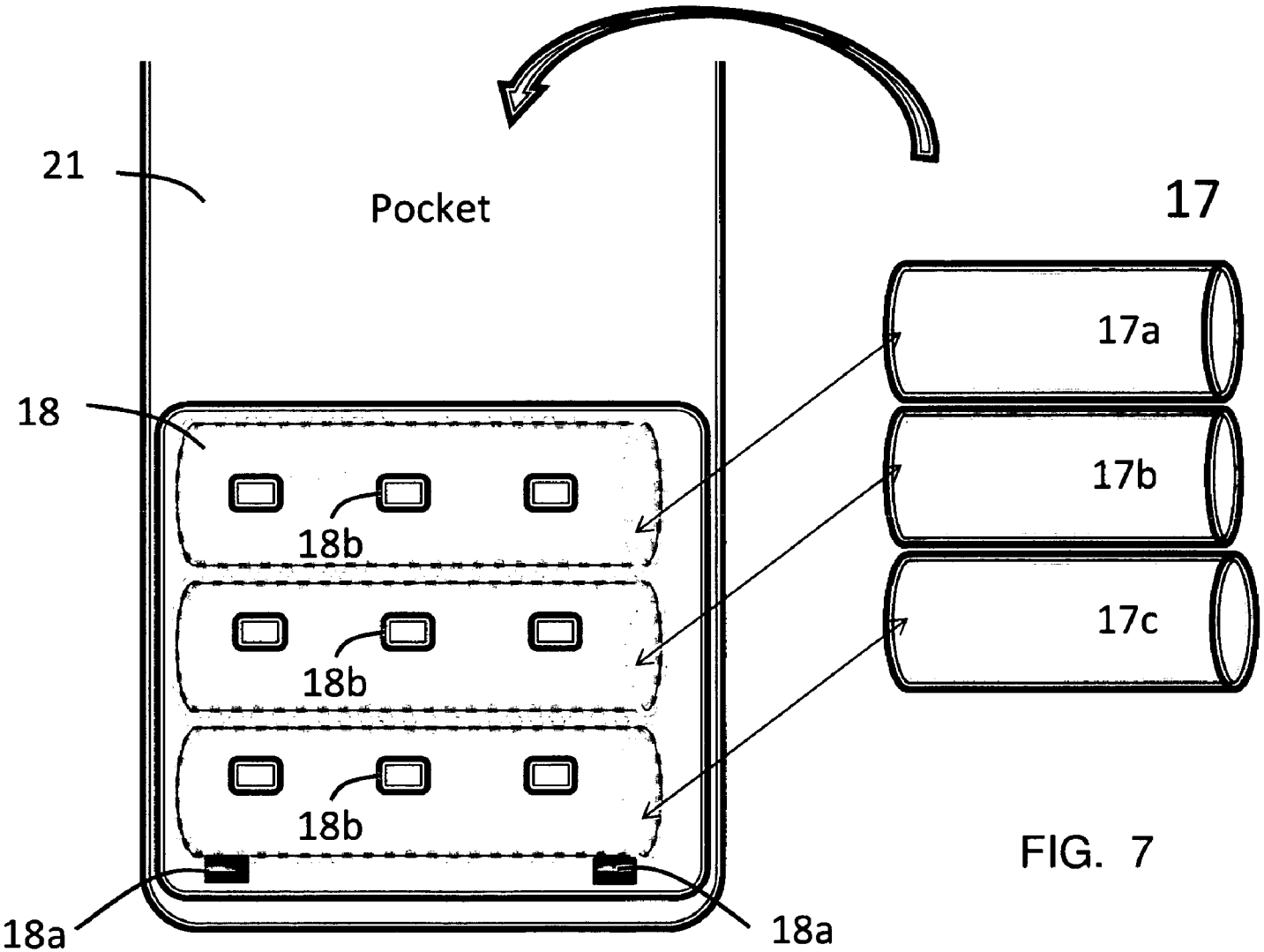
FIG. 7 shows bottom safety bumpers for a pocket coverlet in accordance with one embodiment of the invention.

FIG. 7 shows a pocket coverlet 21 including one or more detachable inserts 17. In one arrangement, the one or more detachable inserts 17 can be one or more bottom safety bumpers (17*a-c*) that can be detachably located at a bottom of the pocket to establish the depth of the pocket. The bottom safety bumpers can sufficiently center a baby in the pocket, sufficiently prevent the baby from sliding down in the pocket, and keep the baby's head at a center of the pillow. A bumper wrap 18 can enclose and fasten the one or more safety bumpers together at a bottom of the pocket. The bumper wrap 18 can include enclosing attachments 18*b*, such as Velcro pads, to accommodate one, two, or all three safety bumpers shown. The enclosing attachments 18*b* are staggered at proper wrap intervals to allow for proper closing together of the safety bumpers 17. Securing the pillow 13 and the pocket coverlet 21 to the fitted sheet-blanket and adjusting the size of the pocket allows the baby to have use of a pillow for neck and cradling support. The slightly raised pillow 13, elevates the baby's head which can be beneficial in helping the baby to breathe more easily.

FIG. 7 shows cylinder shaped safety bumpers 17 that are utilized to custom fit the pocket coverlet 21 to the baby. These safety bumpers 17 can be inserted at the bottom of the pocket to ensure the positioning of the baby within the pocket 21 relative to the pillow 13. That is, the safety bumpers 17 when positioned at the bottom of the pocket, establish the depth of the pocket. This also ensures that the baby's head remains on the pillow 13. The baby's feet, when placed in the pocket, rest above the safety bumpers thereby preventing the baby from sliding in the pocket.

The safety bumpers 17 can be fastened secure inside the blanket coverlet 21 and can be removed at anytime allowing for the growth of the baby. In another arrangement, the pocket coverlet 21 can include detachable footing nets, or mesh-like fabrics, that connect the pocket coverlet 21 to the fitted sheet 30 at various depth levels. The attachable inserts provide an adjustable depth of the pocket relative to the pillow.

Figure 8:
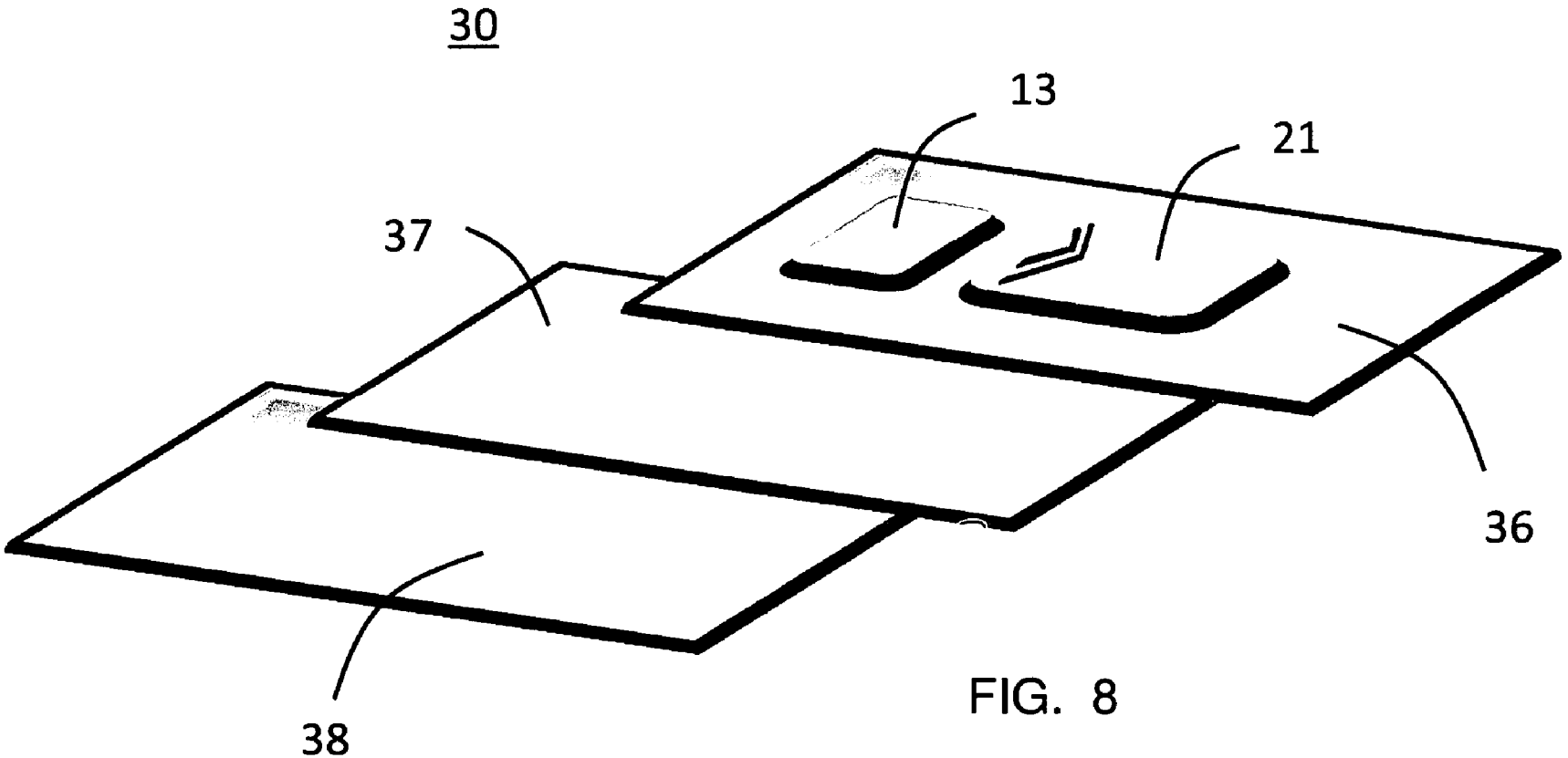
FIG. 8 shows a layering of a fitted sheet-blanket in accordance with one embodiment of the invention.

FIG. 8 illustrates multiple layers of the fitted sheet-blanket 30. The sheet-blanket 30 can comprise three layers of material, for example, a top layer fabric, a middle cotton batting layer, and a bottom layer fabric. The top layer 36 securely includes a portion of the first attachment 24 for the pocket coverlet 21, and a portion of the second attachment 16 for the pillow 13. The top layer 36 may also comprise waterproof material, or fabrics that wick away moisture. The center layer 37 can be a cotton batting, or any other soft natural fabric, used for comfort and durability. The center layer 37 can provide additional padding which to provide further security or tight fitting. The center layer 37 can also be removed and replaced. The attached bottom layer 38 covers the mattress and can be fastened to the upper two layers by a sleeve (not shown) which encompasses a heavy-duty elastic that is sewn around the entirety of the fitted sheet-blanket 30.

Figure 9:
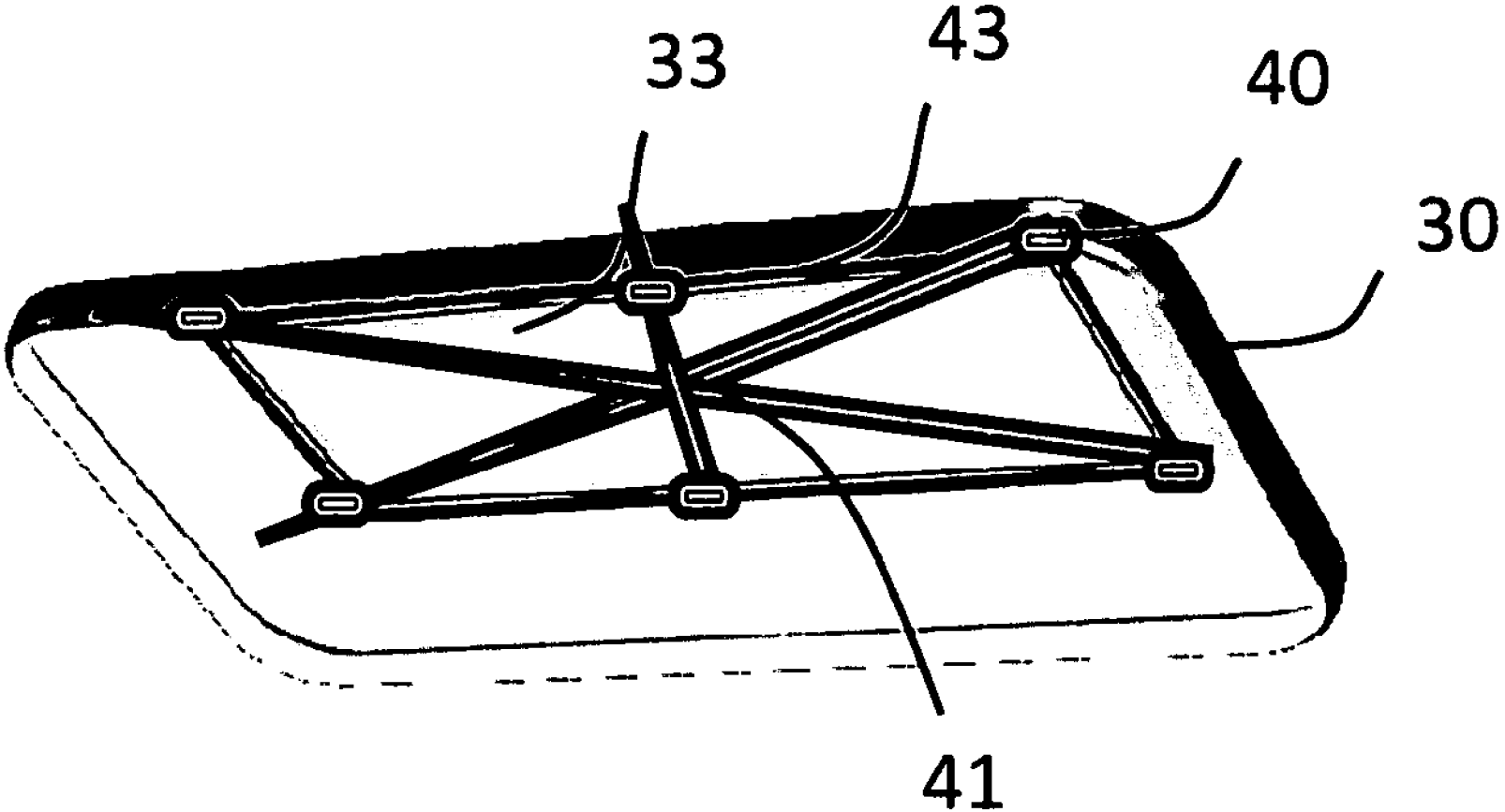
FIG. 9 shows an underneath attachment of a fitted sheet-blanket in accordance with one embodiment of the invention.

FIG. 9 illustrates an underneath view of the fitted sheet-blanket 30 in one embodiment on a mattress 33 showing elastic suspenders 41. The suspenders 41 are added for additional security used for customizing the size of the sheet-blanket to fit alternative sleeping surfaces such as a pack-n-play. That is, the fitted sheet-blanket 30 can include at least one underside detachable elastic strap so as to strap around a crib mattress.

In another arrangement, the fitted sheet-blanket 30 can fit around the mattress 33 without the suspenders 41. An elastic stretch band 43 can be placed on the periphery of the fitted-sheet blanket 30 to provide a taut fit on the mattress 33. In this arrangement, the fitted sheet-blanket can include an in-seamed elastic strap around a lower periphery of the fitted sheet-blanket so as to fit taut on a crib mattress 33 or bassinet mattress 33.

As illustrated in FIGS. 1-9, one embodiment of the snuggle pocket has been shown. The present invention, Snuggle Pockets, can provide a safe environment for babies to sleep. It also adds comfort and support for baby's growth and development. The snuggle pocket embodiment includes the fitted sheet-blanket 30 having the first attachment 24/26 and second attachment 15/16 on a top of the fitted sheet-blanket 30, the pocket coverlet 21 securely detachable to the first attachment 24/26 to form the open-ended pocket that is approximately centered on the fitted sheet-blanket 30, and the pillow 13 securely detachable to the second attachment and located above the pocket that is also approximately centered on the fitted sheet-blanket. The fitted sheet-blanket is intended to fit taut around a crib or bassinet mattress, and the pocket coverlet and pillow are approximately centered and held taut by the first attachment and second attachment on the fitted sheet-blanket.

In another embodiment, the pocket coverlet 21 includes a secure built-in pillow 13 zipped onto a fitted sheet-blanket 30 which fits taut on the crib or bassinet mattress 33 with heavy-duty elastic 43. The pillow 13 and blanket coverlet 21 are each attached to the sheet-blanket 30 by separate molded plastic zippers and stitched fabric casings.

The pocket coverlet 21 is constructed of two layers of material to ensure warmth and comfort to the baby. The pocket coverlet 21 is detachable for easy washing. The detachable zipped pocket coverlet 21 allows for easy access to wash and change the baby. To ensure that the baby's head has comfort and support, memory foam 10 was used in the pillow. The memory foam pillow 10 is beneficial to help alleviate the common cause of flat head syndrome, known as Positional Plagiocephaly. The pillow 13 is detachable for easy washing. The fitted sheet-blanket 30 has three layers of material for long lasting and durable wear. This also contributes to comfort and replaces the need for a mattress pad. The safety bumpers 17 can be placed into the pocket to modify the pocket depth and size. These safety bumpers can be secured in the pocket with Velcro®.

In summary, the present invention relates to baby bedding for cribs, bassinets, and pack-n-play furniture currently sold in the market today. The baby bedding in one embodiment can include a tight fitted sheet-blanket 30 that covers the mattress and can be secured to custom fit baby furniture by elastic security bands 41, or elastic seams 43, on the underneath side of the mattress 33 able to adjust the constriction to different baby furniture. These elastic security bands can be made with heavy-duty elastic, covered with a cotton casing and fastened at both ends by metal clamps, like the clamps found on suspenders. This allows the baby's bedding to be used when traveling.

The fitted sheet-blanket 30 can be constructed of a top and bottom layer of heavy cotton material providing a soft and warm feel. Added for comfort and protection from the hard and plastic covered mattress surface is a middle layer of soft cotton fabric sewn in between the two layers of heavy cotton. This layer can provide a baby with a protected and comfortable surface for a more restful sleep.

The pillow 13 portion can be covered in cotton and the cushion can be assembled with memory foam 10 and covered in a cotton sleeve. The foam 10 can be removed from the slot in the back 12 of the pillow. The memory foam 10 can provide the baby support to their soft heads and fragile necks. The memory foam 10 can be less than two inches in thickness. The pillow 13 can be held stationary to the fitted sheet-blanket 30 by a molded plastic zipper. A zipper casing 15/16 can be sewn from the pillow 13 to the fitted sheet-blanket 30 so that a baby's head does not get under the pillow at anytime thereby providing one measure of safety. The pillow 13 can be unzipped 15/16 and removed from the fitted blanket 30 for washing and disinfecting The pocket coverlet 21 can be secured in the same fashion as the pillow 13 with a zipper casing 22/24. The pocket coverlet 21 can be held stationary to the fitted sheet-blanket 30 by a molded plastic zipper 27. A zipper casing 22/24 can be sewn on to the pocket coverlet 21 and also to the fitted sheet-blanket 30 positioning the pocket coverlet in the center of the crib, bassinet or pack-n-play, therefore keeping the baby in the center for protection. The pocket coverlet 21 can be double layered with cotton blend materials making it warm but breathable. The pocket coverlet 21 can fit securely under the baby's arms which adds security and a custom fit.

The present invention can include safety bumpers 17 to fasten inside the pocket. These safety bumpers (17*a,b,c*) can adjust to fit a baby's individual needs. The safety bumpers (17*a,b,c*) can also be made from memory foam and cotton—are in the shape of a cylinder. They can be removed and washed. The crib pocket coverlet 21 can fit babies up to a year and the bassinet pockets coverlet can fit babies up to an average of three months. After the baby has outgrown their pockets they can be easily unzipped and removed. The pillow 13 and pocket coverlet 21 can be removed from the fitted sheet-blanket 30 and be turned over to utilize the reverse side for as long as the baby uses its crib and/or pack-n-play.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A fitted sheet-blanket suitable for use with a crib or bassinet mattress, the fitted sheet-blanket comprising:

a pocket coverlet securely detachable on a top of the fitted sheet-blanket when fitted onto the crib or bassinet mattress to form an open-ended pocket on the filled sheet-blanket; and a pillow securely detachable on the top of the fitted sheet-blanket when fitted onto the crib or bassinet mattress and located above the open-ended pocket, wherein the pocket coverlet includes one or more detachable inserts to provide an adjustable depth of the pocket relative to the pillow, wherein the one or more detachable inserts comprise one or more bottom safety fabric bumpers at a bottom inside of the pocket to establish the adjustable depth of the pocket and provide a snug fit for a baby within the open-ended pocket.

2. The fitted sheet-blanket of claim 1, wherein the fitted sheet-blanket fits taut around a crib or bassinet mattress to pull the pocket coverlet tight so as to secure and fit taut the baby safely on its back to keep the baby securely and firmly positioned within the pocket and provide the snug fit within the open-ended pocket.

3. The fitted sheet-blanket of claim 2, wherein the fitted sheet-blanket includes an in-seamed elastic strap around a lower periphery of the fitted sheet-blanket so as to fit taut on a crib mattress or bassinet mattress and pull the pocket coverlet taut.

4. The filled sheet-blanket of claim 2, wherein the fitted sheet-blanket includes a top layer fabric, a middle cotton batting layer, and a bottom layer fabric.

5. The fitted sheet-blanket of claim 1, wherein the pocket coverlet is approximately centered on the fitted sheet-blanket so as to be sufficiently away from crib or bassinet railings.

6. The fitted sheet-blanket of claim 1, wherein the pocket coverlet is fastened down by a zipper onto the fitted sheet-blanket to form the pocket, and the pillow is fastened down by a zipper onto the fitted sheet-blanket above the pocket so as to prevent the baby's head from getting under the pillow.

7. The fitted sheet-blanket of claim 1, wherein the one or more bottom safety bumpers sufficiently center the baby in the pocket, sufficiently prevent the baby from sliding down in the pocket, and keep the baby's head at a center of the pillow.

8. The fitted sheet-blanket of claim 1, further comprising a bumper wrap to enclose and fasten the one or more safety bumpers together at a bottom of the pocket.

9. The fitted sheet-blanket of claim 1, wherein the pillow is less than 2 inches thick and includes memory foam that distributes a weight of the baby's neck and head to alleviate flattened head syndrome.

10. The fitted sheet-blanket of claim 1, wherein the fitted sheet-blanket includes at least one underside detachable elastic strap so as to strap around a crib mattress and pull the packet coverlet taut.

11. The fitted sheet-blanket of claim 1, wherein the pocket coverlet is pulled sufficiently tight and fastened down 2 inches or more away from the pillow such that the pocket coverlet does not contact any portion of the pillow.

12. The fitted sheet-blanket of claim 1, wherein the pocket coverlet includes a triangular extension to provide comfort and warmth.

13. A snuggle pocket, comprising:

a fitted sheet-blanket having a first attachment and second attachment on a top of the fitted sheet-blanket when fitted onto a crib or bassinet mattress;

a pocket coverlet securely detachable to the first attachment to form an open-ended pocket that is approximately centered on the fitted sheet-blanket; and a pillow securely detachable to the second attachment and located above the pocket that is also approximately centered on the fitted sheet-blanket, wherein the fitted sheet-blanket fits taut around a crib or bassinet mattress, and the pocket coverlet and pillow are approximately centered and held taut by the first attachment and second attachment on the fitted sheet-blanket;

wherein the pocket coverlet includes one or more bottom safety fabric bumpers placed at a bottom inside of the pocket to establish an adjustable depth of the pocket;

wherein the fitted sheet-blanket fits taut around a crib or bassinet mattress to pull the pocket coverlet tight so as to secure and fit taut a baby safely on its back to keep the baby securely and firmly positioned within the pocket and provide a snug fit for the baby within the open-ended pocket.

14. The snuggle pocket of claim 13, wherein the pocket coverlet is fastened down by a first U-shaped zipper attachment open-ended at a top of the fitted sheet-blanket to form the pocket, and the pillow is fastened down by a second U-shaped zipper attachment open-ended at the top of the fitted sheet-blanket.

15. The fitted sheet-blanket of claim 14, wherein the first attachment is interchangeable with the pocket coverlet such that the pocket coverlet exposes a first fabric side to the interior of the open-ended pocket in a first arrangement, and a second fabric side to the interior of the open-ended pocket in a second arrangement.

16. The fitted sheet-blanket of claim 13, wherein the one or more detachable safety bumpers sufficiently center the baby in the open-ended pocket to prevent the baby from sliding down in the pocket and to keep the baby's head at a center of the pillow.

17. The sheet-blanket of claim of claim 13, wherein the pillow comprises a memory foam covered by a cotton sleeve, wherein a slot is formed from portions of the pillow, the memory foam is inserted in the pillow through the slot, and the slot is underneath the pillow.

18. A fitted sheet-blanket suitable for use with a crib mattress or bassinet mattress, the filled sheet-blanket comprising:

a pocket coverlet securely detachable by a first U-shaped zipper on a top of the fitted sheet-blanket when fitted onto the crib or bassinet mattress to form an open-ended pocket approximately centered on the fitted sheet-blanket, wherein the pocket coverlet includes one or more detachable safety fabric bumpers positioned at a inside bottom of the open-ended pocket that provide an adjustable depth of the pocket; and a pillow approximately centered and securely detachable and held down by a second U-shaped zipper on the top of the fitted sheet-blanket when fitted onto the crib or bassinet mattress and located at least 2 inches above the packet to provide head and neck support and to alleviate flattened head syndrome, wherein the fitted sheet-blanket fits taut around the crib or bassinet mattress to pull the pocket coverlet tight so as to secure and fit taut a baby safely on the mattress and keep the baby securely and firmly positioned within the pocket and provide a snug fit for the baby in the pocket.

* * * * *